US009630246B2

(12) United States Patent
Pham et al.

(10) Patent No.: US 9,630,246 B2
(45) Date of Patent: Apr. 25, 2017

(54) CONTAINMENT GATE FOR INLINE TEMPERATURE CONTROL MELTING

(75) Inventors: Quoc Tran Pham, Anaheim, CA (US); Michael Deming, Trabuco Canyon, CA (US); Theodore A. Waniuk, Lake Forest, CA (US); Sean O'Keeffe, Tustin, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 14/350,498

(22) PCT Filed: Oct. 14, 2011

(86) PCT No.: PCT/US2011/056399

§ 371 (c)(1),
(2), (4) Date: May 30, 2014

(87) PCT Pub. No.: WO2013/055365

PCT Pub. Date: Apr. 18, 2013

(65) Prior Publication Data

US 2015/0144292 A1 May 28, 2015

(51) Int. Cl.
*B22D 25/06* (2006.01)
*B22D 17/04* (2006.01)
(Continued)

(52) U.S. Cl.
CPC ..... *B22D 25/06* (2013.01); *B22D 17/04* (2013.01); *B22D 17/14* (2013.01); *B22D 17/20* (2013.01);
(Continued)

(58) Field of Classification Search
CPC ..... B22D 25/06; B22D 17/04; B22D 17/20; B22D 17/14; B22D 17/203; B22D 17/2053; B22D 17/2038; B22D 17/22
See application file for complete search history.

(56) References Cited

U.S. PATENT DOCUMENTS 4,598,762 A * 7/1986 Glas ..... B22D 17/203 164/312
5,288,344 A 2/1994 Peker et al.
(Continued)

FOREIGN PATENT DOCUMENTS

CN 87202114 4/1988
EP 0845316 6/1998
(Continued)

OTHER PUBLICATIONS

Japanese Application No. 2014-535704, Notice of Reasons for Rejection, Issue date Sep. 30, 2014.
(Continued)

*Primary Examiner* — Kevin P Kerns
*Assistant Examiner* — Steven Ha
(74) *Attorney, Agent, or Firm* — Brownstein Hyatt Farber Schreck, LLP

(57) ABSTRACT

Disclosed is an apparatus comprising at least one gate and a vessel, the gate being configured to move between a first position to restrict entry into an ejection path of the vessel and contain a material in a meltable form within the vessel during melting of the material, and a second position to allow movement of the material in a molten form through the ejection path. The gate can move linearly or rotate between its first and second positions, for example. The apparatus is configured to melt the material and the at least one gate is configured to allow the apparatus to be maintained under vacuum during the melting of the material. Melting can be performed using an induction source. The apparatus may also include a mold configured to receive molten material and for molding a molded part, such as a bulk amorphous alloy part.

28 Claims, 10 Drawing Sheets

(51) Int. Cl.

| | |
|---|---|
| ***B22D 17/20*** | (2006.01) |
| ***C22C 45/10*** | (2006.01) |
| ***C22C 45/00*** | (2006.01) |
| ***C22C 45/02*** | (2006.01) |
| ***B22D 17/14*** | (2006.01) |
| ***B22D 17/22*** | (2006.01) |
| ***B22D 27/15*** | (2006.01) |

(52) U.S. Cl.

CPC ..... *B22D 17/203* (2013.01); *B22D 17/2038* (2013.01); *B22D 17/22* (2013.01); *B22D 27/15* (2013.01); *C22C 45/00* (2013.01); *C22C 45/001* (2013.01); *C22C 45/003* (2013.01); *C22C 45/02* (2013.01); *C22C 45/10* (2013.01)

(56) References Cited

U.S. PATENT DOCUMENTS

| | | | | |
|---|---|---|---|---|
| 5,329,983 | A * | 7/1994 | Cook | B22D 19/14 164/137 |
| 5,368,659 | A | 11/1994 | Peker et al. | |
| 5,618,359 | A | 4/1997 | Lin et al. | |
| 5,711,363 | A | 1/1998 | Scruggs | |
| 5,735,975 | A | 4/1998 | Lin et al. | |
| 6,021,840 | A | 2/2000 | Colvin | |
| 6,283,197 | B1 | 9/2001 | Kono | |
| 6,325,868 | B1 | 12/2001 | Kim et al. | |
| 7,575,040 | B2 | 8/2009 | Johnson | |
| 8,480,864 | B2 | 7/2013 | Farmer et al. | |
| 2004/0094205 | A1 * | 5/2004 | Shuter | F16K 35/022 137/385 |
| 2007/0277953 | A1 | 12/2007 | Ward | |

FOREIGN PATENT DOCUMENTS

| | | |
|---|---|---|
| GB | 784363 | 10/1957 |
| JP | H0433453 | 3/1992 |
| JP | H09001307 | 1/1997 |
| JP | H09323146 | 12/1997 |
| JP | H11151560 | 6/1999 |
| JP | 2001303218 | 10/2001 |
| JP | 2004079677 | 3/2004 |
| JP | 2004291043 | 10/2004 |
| JP | 2006122992 | 5/2006 |
| JP | 2007105746 | 4/2007 |
| JP | 2012125831 | 7/2012 |

OTHER PUBLICATIONS

International Search Report/Written Opinion, mail date Jul. 9, 2012, PCT/ISA/210, PCT/ISA/220, PCT/ISA/237.

Japanese Final Office Action dated Feb. 17, 2015, JP 2014-535704, 6 pages.

Korean Office Action dated May 1, 2015, KR 10-2014-7012977, 9 pages.

Korean Office Action dated Dec. 24, 2015, KR 10-2014-7012977, 5 pages.

Chinese Office Action dated Apr. 1, 2015, CN 201180075324.0, 14 pages.

Inoue et al., "Bulk amorphous alloys with high mechanical strength and good soft magnetic properties in Fe—Tm—B (Tm-IV-VIII group transition metal) system," Appl. Phys. Lett., vol. 74, No. 4, 1997, pp. 464-466.

Shen et al, "Bulk Glassy $Co_{43}Fe_{20}Ta_{5.5}B_{31.5}$ Alloy with High Glass-Forming Ability and Good Soft Magnetic Properties," Materials transactions, vol. 42, No. 10, 2001, pp. 2136-2139.

* cited by examiner

CONTAINMENT GATE FOR INLINE TEMPERATURE CONTROL MELTING

FIELD

The present disclosure is generally related to a gate and a vessel for melting material and retaining molten material therein during melting.

BACKGROUND

Some injection molding machines use an induction coil to melt material before injecting the material into a mold. However, magnetic fluxes from the induction coil tend to cause molten materials to move unpredictably, which can make it difficult to control the uniformity and temperature of the molten material. Additionally, the molten material has to be retained in the melt zone so that it does not mix too much or cool too quickly.

SUMMARY

A proposed solution according to embodiments herein for improving molded objects or parts is to use bulk-solidifying amorphous alloys.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to +0.2%, such as less than or equal to ±0.1%, such as less than or equal to +0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
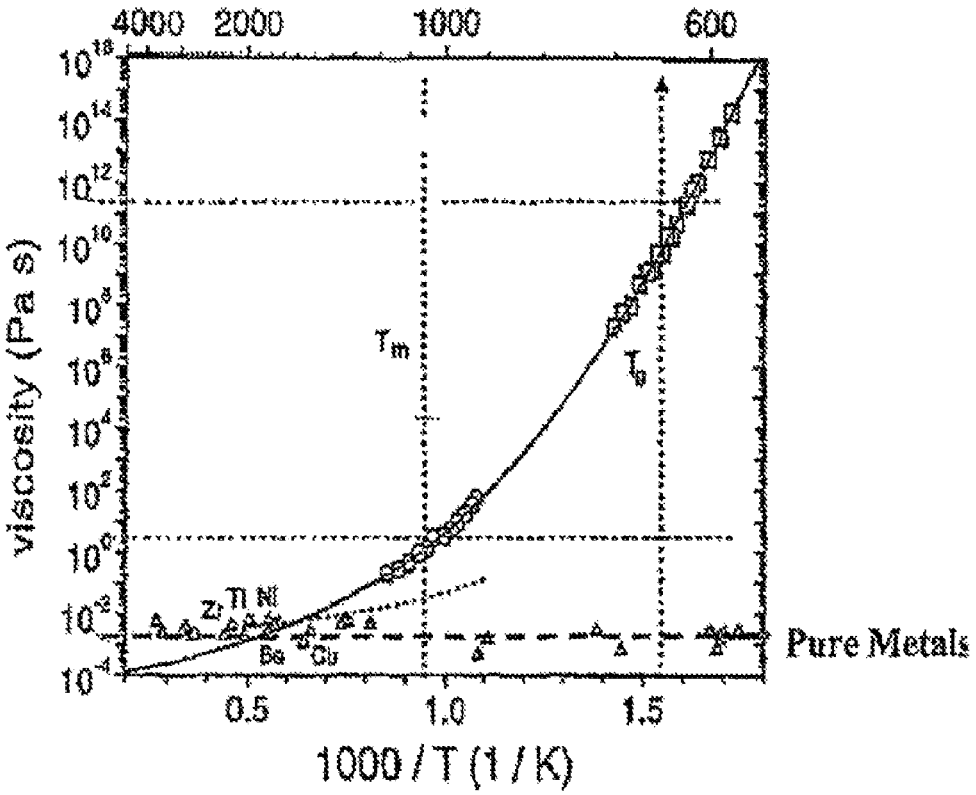
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
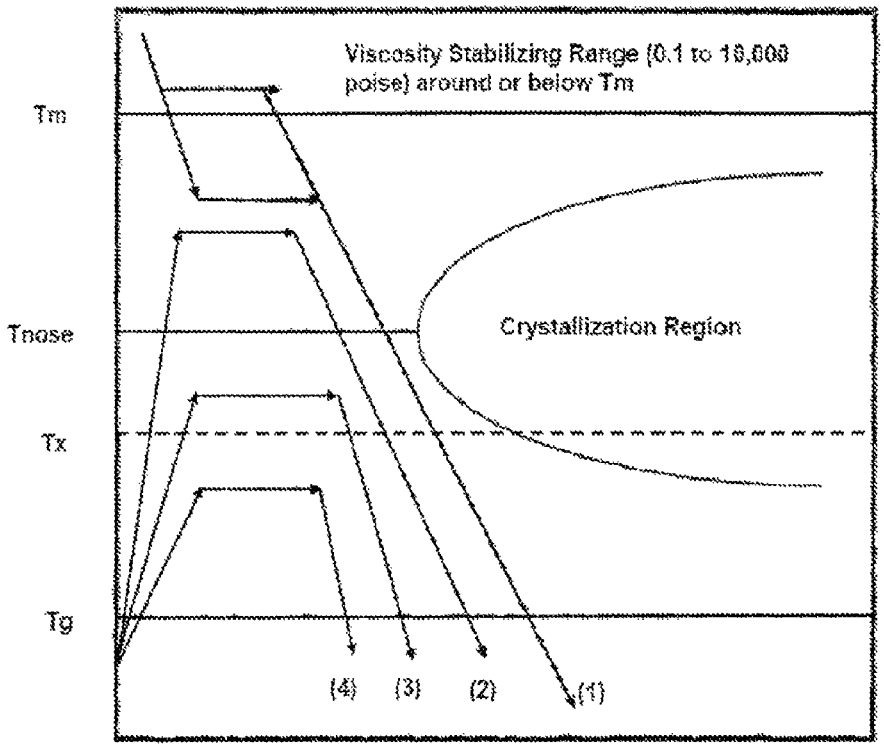
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10, microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The term's "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle (s(x), s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 0.2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™, and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods, techniques, and devices illustrated herein are not intended to be limited to the illustrated embodiments.

As disclosed herein, an apparatus or a system (or a device or a machine) is configured to perform melting of and injection molding of material(s) (such as amorphous alloys). The apparatus is configured to process such materials or alloys by melting at higher melting temperatures before injecting the molten material into a mold for molding. As further described below, parts of the apparatus are positioned in-line with each other. In accordance with some embodiments, parts of the apparatus (or access thereto) are aligned on a horizontal axis.

The following embodiments are for illustrative purposes only and are not meant to be limiting.

Figure 3:
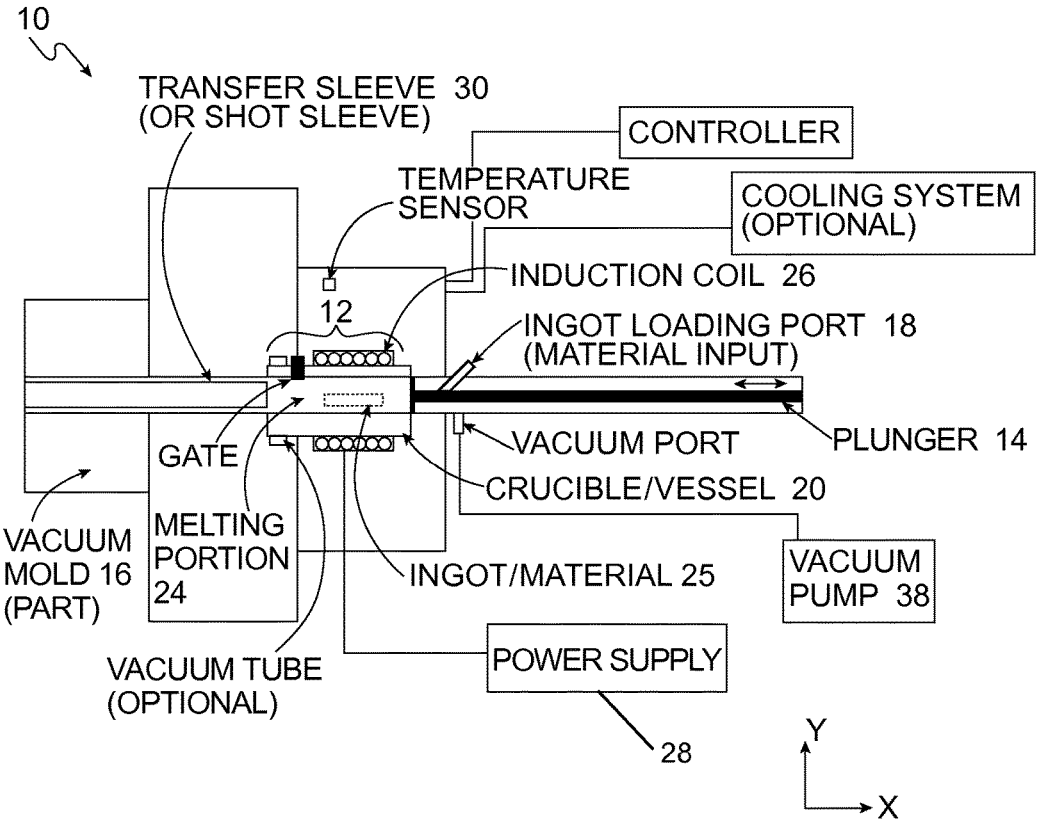
FIG. 3 illustrates an injection molding system with a gate in accordance with an embodiment of the disclosure.

FIG. 3 illustrates a schematic diagram of such an exemplary system. More specifically, FIG. 3 illustrates an injection molding apparatus or system 10. In accordance with an embodiment, injection molding system 10 has a melt zone 12 configured to melt meltable material received therein, and at least one plunger rod 14 configured to eject molten material from melt zone 12 and into a mold 16. In an embodiment, at least plunger rod 14 and melt zone 12 are provided in-line and on a horizontal axis (e.g., X axis), such that plunger rod 14 is moved in a horizontal direction (e.g., along the X-axis) substantially through melt zone 12 to move the molten material into mold 16. The mold can be positioned adjacent to the melt zone.

The meltable material can be received in the melt zone in any number of forms. For example, the meltable material may be provided into melt zone 12 in the form of an ingot (solid state), a semi-solid state, a slurry that is preheated, powder, pellets, etc. In some embodiments, a loading port (such as the illustrated example of an ingot loading port 18) may be provided as part of injection molding system 10. Loading port 18 can be a separate opening or area that is provided within the machine at any number of places. In an embodiment, loading port 18 may be a pathway through one or more parts of the machine. For example, the material (e.g., ingot) may be inserted in a horizontal direction into vessel 20 by plunger 14, or may be inserted in a horizontal direction from the mold side of the injection system 10 (e.g., through mold 16 and/or through a transfer sleeve 30 into vessel 20). In other embodiments, the meltable material can be provided into melt zone 12 in other manners and/or using other devices (e.g., through an opposite end of the injection system).

Melt zone 12 includes a melting mechanism configured to receive meltable material and to hold the material as it is heated to a molten state. The melting mechanism may be in the form of a vessel 20, for example, that has a body for receiving meltable material and configured to melt the material therein. A vessel as used throughout this disclosure is a container made of a material employed for heating substances to high temperatures. For example, in an embodiment, the vessel may be a crucible, such as a boat style crucible, or a skull crucible. In an embodiment, vessel 20 is a cold hearth melting device that is configured to be utilized for meltable material(s) while under a vacuum (e.g., applied by a vacuum device 38 or pump). In one embodiment, described further below, the vessel is a temperature regulated vessel.

Vessel 20 may also have an inlet for inputting material (e.g., feedstock) into a receiving or melting portion 24 of its body. In the embodiments shown in the Figures, the body of vessel 20 comprises a substantially U-shaped structure. However, this illustrated shape is not meant to be limiting. Vessel 20 can comprise any number of shapes or configurations. The body of the vessel has a length and can extend in a longitudinal and horizontal direction, such that molten material is removed horizontally therefrom using plunger 14. For example, the body may comprise a base with side walls extending vertically therefrom. The material for heating or melting may be received in a melting portion 24 of the vessel. Melting portion 24 is configured to receive meltable material to be melted therein. For example, melting portion 24 has a surface for receiving material. Vessel 20 may receive material (e.g., in the form of an ingot) in its melting portion 24 using one or more devices of an injection system for delivery (e.g., loading port and plunger).

In an embodiment, body and/or its melting portion 24 may comprise substantially rounded and/or smooth surfaces. For example, a surface of melting portion 24 may be formed in an arc shape. However, the shape and/or surfaces Of the body are not meant to be limiting. The body may be an integral structure, or formed from separate parts that are joined or machined together. The body of vessel 20 may be formed from any number of materials (e.g., copper, silver), include one or more coatings, and/or configurations or designs: For example, one or more surfaces may have recesses or grooves therein.

The body of vessel 20 may be configured to receive the plunger rod therethrough in a horizontal direction to move the molten material. That is, in an embodiment, the melting mechanism is on the same axis as the plunger rod, and the body can be configured and/or sized to receive at least part of the plunger rod. Thus, plunger rod 14 can be configured to move molten material (after heating/melting) from the vessel by moving substantially through vessel 20, and into mold 16. Referencing the illustrated embodiment of system 10 in FIG. 3, for example, plunger rod 14 would move in a horizontal direction from the right towards the left, through vessel 20, moving and pushing the molten material towards and into mold 16.

To heat melt zone 12 and melt the meltable material received in vessel 20, injection system 10 also includes a heat source that is used to heat and melt the meltable material. At least melting portion 24 of the vessel, if not substantially the entire body itself, is configured to be heated such that the material received therein is melted. Heating is accomplished using, for example, an induction source 26 positioned within melt zone 12 that is configured to melt the meltable material. In an embodiment, induction source 26 is positioned adjacent vessel 20. For example, induction source 26 may be in the form of a coil positioned in a helical pattern substantially around a length of the vessel body. Accordingly, vessel 20 may be configured to inductively melt a meltable material (e.g., an inserted ingot) within melting portion 24 by supplying power to induction source/coil 26, using a power supply or source 28. Thus, the melt zone 12 can include an induction zone. Induction coil 26 is configured to heat up and melt any material that is contained by vessel 20 without melting and wetting vessel 20. Induction coil 26 emits radiofrequency (RF) waves towards vessel 20. As shown, the body and coil 26 surrounding vessel 20 may be configured to be positioned in a horizontal direction along a horizontal axis (e.g., X axis).

In one embodiment, the vessel 20 is a temperature regulated vessel. Such a vessel may include one or more temperature regulating lines configured to flow a liquid (e.g., water, or other fluid) therein for regulating a temperature of the body of vessel 20 during melting of material received in the vessel (e.g., to force cool the vessel). Such a forced-cool crucible can also be provided on the same axis as the plunger rod. The cooling line(s) can assist in preventing excessive heating and melting of the body of the vessel 20 itself. Cooling line(s) may be connected to a cooling system configured to induce flow of a liquid in the vessel. The cooling line(s) may include one or more inlets and outlets for the liquid or fluid to flow therethrough. The inlets and outlets of the cooling lines may be configured in any number of ways and are not meant to be limited. For example, cooling line(s) may be positioned relative to melting portion 24 such that material thereon is melted and the vessel temperature is regulated (i.e., heat is absorbed, and the vessel is cooled). The number, positioning and/or direction of the cooling line(s) should not be limited. The cooling liquid or fluid may be configured to flow through the cooling line(s) during melting of the meltable material, when induction source 26 is powered.

After the material is melted in the vessel 20, plunger 14 may be used to force the molten material from the vessel 20 and into a mold 16 for molding into an object, a part or a piece. In instances wherein the meltable material is an alloy, such as an amorphous alloy, the mold 16 is configured to form a molded bulk amorphous alloy object, part, or piece. Mold 16 has an inlet for receiving molten material therethrough. An output of the vessel 20 and an inlet of the mold 16 can be provided in-line and on a horizontal axis such that plunger rod 14 is moved in a horizontal direction through body 22 of the vessel to eject molten material and into the mold 16 via its inlet.

As previously noted, systems such as injection molding system 10 that are used to mold materials such as metals or alloys may implement a vacuum when forcing molten material into a mold or die cavity. Injection molding system 10 can further includes at least one vacuum source 38 or pump that is configured to apply vacuum pressure to at least melt zone 12 and mold 16. The vacuum pressure may be applied to at least the parts of the injection molding system 10 used to melt, move or transfer, and mold the material therein. For example, the vessel 20, transfer sleeve 30, and plunger rod 14 may all be under vacuum pressure and/or enclosed in a vacuum chamber.

In an embodiment, mold 16 is a vacuum mold that is an enclosed structure configured to regulate vacuum pressure therein when molding materials. For example, in an embodiment, vacuum mold 16 comprises a first plate (also referred to as an "A" mold or "A" plate), a second plate (also referred to as a "B" mold or "B" plate) positioned adjacently (respectively) with respect to each other. The first plate and second plate generally each have a mold cavity associated therewith for molding melted material therebetween. The cavities are configured to mold molten material received therebetween via an injection sleeve or transfer sleeve 30. The mold cavities may include a part cavity for forming and molding a part therein.

Generally, the first plate may be connected to transfer sleeve 30. In accordance with an embodiment, plunger rod 14 is configured to move molten material from vessel 20, through a transfer sleeve 30, and into mold 16. Transfer sleeve 30 (sometimes referred to as a shot sleeve, a cold sleeve or an injection sleeve in the art and herein) may be provided between melt zone 12 and mold 16. Transfer sleeve 30 has an opening that is configured to receive and allow transfer of the molten material therethrough and into mold 16 (using plunger 14). Its opening may be provided in a horizontal direction along the horizontal axis (e.g., X axis). The transfer sleeve need not be a cold chamber. In an embodiment, at least plunger rod 14, vessel 20 (e.g., its receiving or melting portion), and opening of the transfer sleeve 30 are provided in-line and on a horizontal axis, such that plunger rod 14 can be moved in a horizontal direction through vessel 20 in order to move the molten material into (and subsequently through) the opening of transfer sleeve 30.

Molten material is pushed in a horizontal direction through transfer sleeve 30 and into the mold cavity(ies) via the inlet (e.g., in a first plate) and between the first and second plates. During molding of the material, the at least first and second plates are configured to substantially eliminate exposure of the material (e.g., amorphous alloy) therebetween to at least oxygen and nitrogen. Specifically, a vacuum is applied such that atmospheric air is substantially eliminated from within the plates and their cavities. A vacuum pressure is applied to an inside of vacuum mold 16 using at least one vacuum source 38 that is connected via vacuum lines. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr. An ejector mechanism (not shown) is configured to eject molded (amorphous alloy) material (or the molded part) from the mold cavity between the first and second plates of mold 16. The ejection mechanism is associated with or connected to an actuation mechanism (not shown) that is configured to be actuated in order to eject the molded material or part (e.g., after first and second parts and are moved horizontally and relatively away from each other, after vacuum pressure between at least the plates is released).

Any number or types of molds may be employed in the apparatus 10. For example, any number of plates may be provided between and/or adjacent the first and second plates to form the mold. Molds known as "A" series, "B" series, and/or "X" series molds, for example, may be implemented in injection molding system/apparatus 10.

A uniform heating of the material to be melted and maintenance of temperature of molten material in such an injection molding apparatus 10 assists in forming a uniform molded part. For explanatory purposes only, throughout this disclosure material to be melted is described and illustrated as being in the form of an ingot 25 that is in the form of a solid state feedstock; however, it should be noted that the material to be melted may be received in the injection molding system or apparatus 10 in a solid state, a semi-solid state, a slurry that is preheated, powder, pellets, etc., and that the form of the material is not limiting. To contain material that is being melted and/or molten in such a system, in accordance with this disclosure, at least one gate is provided in the apparatus. The gate is configured to contain molten material within a melt zone of the apparatus, and minimize heat loss. Additionally, the molten material has to be retained in the melt zone so that it does not mix too much or cool too quickly.

In an injection molding apparatus 10 that is positioned inline and in a horizontal direction, to get the most power input into the material for melting, containing it in the melt zone 12, adjacent to induction coil 26, is effective for a consistent melt each cycle (e.g., rather than having molten material flow towards and/or out of the ejection path of the vessel 20).

Accordingly, this disclosure provides several different concepts to address the need for at least one gate within at least the induction/melt zone of an injection molding apparatus/machine. It has been found that without a gate containing the melt within the melt zone, the material to be melted (or molten material) tends to stretch and move beyond range of the melting source (e.g., an induction field) causing a loss in temperature, an increase in power input requirements (e.g., to melt or maintain a temperature of the melt), and a poor quality of formed or molded parts. The disclosed and illustrative embodiments of the gates also ensure that the material to be melted is contained during the heating and melting process without impeding function of other parts of the apparatus, e.g., maintaining the plunger function and the ability to draw sufficient vacuum during the process, and/or affect reliability of the machine. It contains the material during the melting process (e.g., to couple with the RF from induction source 26) and also encourages a steady state temperature distribution while it (the material) is being melted.

When utilizing BMG as the material in the injection molding apparatus 10, using at least one gate as disclosed herein results in a material with a high elastic limit, corrosion resistance, and low density, and is cost effective.

The gate (or gates) can be made from any material, including, but not limited to, an RF transparent Material (e.g., so that the induction current or RF from the heat/induction source 26 does not heat up the gate). The material can be a material that is capable with being temperature controlled via a gas, a fluid or other means. For example, such exemplary materials that may be used for forming a gate can be a metal such as copper, a glass, a ceramic, or any other material. In an embodiment, the gate can be made of a high conducting metal with small skin depth, such as copper or copper alloy. The gate can also be coated with a magnetic material, a ceramic, a non-magnetic material, an insulation or other material.

Furthermore, it should be noted that a body of the gate need not be made of entirely the same material. For example, the gate may include a tip made of one or more materials that are configured to be heat resistant and/or configured to contain material during melting without damage thereto, and the body of the gate may be made of another material.

In the disclosed embodiments herein, for example, each gate is movable to a first (closed) position and a second (opened) position. The gate is configured to move between a first position to restrict entry into an ejection path of vessel 20 and contain a material in a meltable form within vessel 20 during melting of the material, and a second position to allow movement of the material in a molten form through the ejection path. The apparatus 10 is configured to melt the material, and the gate is configured to allow apparatus 10 to be maintained under vacuum during the melting and forming/casting of the material.

Exemplary embodiments of both a single gate (e.g., wherein plunger 14 is in contact with ingot during the melt phase) (e.g., see FIGS. 4-14) and a dual gate system (e.g., see FIGS. 15-16) are further described below. In an embodiment that employs as a single gate system, for example, plunger 14 can be configured to restrict an opposite side of the ejection path in vessel 20 and contain the material in a meltable form within vessel 20 during melting of the material. Plunger 14 can also be further configured to move the material in a molten form through the ejection path of vessel 20 when the gate is moved to the second position (open position) after melting, and towards and into mold 16. For example, the tip of plunger 14 may be formed from a material that allows for high heat and minimal energy loss from melt, such as ceramic. In an embodiment, the plunger tip can be cooled through liquid/gas cooling during melting and/or once inside mold to facilitate solidification. Using a single gate with a plunger, for example, provides a simple design with fewer seals. Alternatively, a dual gate system can allow gates to heat during melting phase. Such a setup allows tip of plunger 14 to remain cool and safely retracted from melt zone 12 during the melt phase (heating of material). After gates retract to a second position, the plunger 14 can contact the molten material and the melt can be cooled prior to insertion to mold 16.

In each of the illustrated embodiment of FIGS. 4-16, vessel 20 is positioned along a horizontal axis (X-axis) such that the movement of the material in the molten form is in a horizontal direction when directed through the ejection path (e.g., using plunger 14). Surrounding at least part of vessel 20 is induction source 26 in the form of a coil that is positioned and configured to heat material for melting. For illustrative purposes only, the illustrated view of vessel 20 is a cross-sectional view taken along X-axis of a U-shaped boat/Vessel, having a melting portion 24 therein for receiving material to be melted (e.g., in the form of an ingot). The overhead view shown in FIG. 14, for example, may better illustrate an example of the U-shaped vessel provided in the illustrations. However, the illustrated shape is not meant to be limiting.

Moreover, each embodiment includes a sleeve 42 positioned to surround at least part of vessel 20. Sleeve 42 extends in a horizontal direction with vessel 20 (i.e., along the X-axis). Sleeve 42 may be made of any material and provided in any form, and it not meant to be limiting. For example, the sleeve 42 may be a formed quartz tube. Sleeve 42 is placed around an outside of vessel 20 such that vacuum can be applied and the melting process implemented under vacuum. Sleeve 42 is configured to allow positioning of gate 40 in first (closed) position and second (open) position.

Also, an actuation mechanism is associated with each of the gate(s) to selectively move the gate(s) between the first position and the second position. Any sort of actuation mechanism could be used and/or controlled (e.g., by a controller). Some examples of actuation mechanisms that may be used with any of the herein disclosed embodiments of gate(s) include a pneumatic piston, a hydraulic (fluid) piston, a solenoid, and/or a servo motor. The gate(s) can be controlled using a direct shaft, magnet, gravity, or other devices. The type of actuation mechanism used to move a gate to and between first and second positions is not meant to be limiting.

Figure 4:
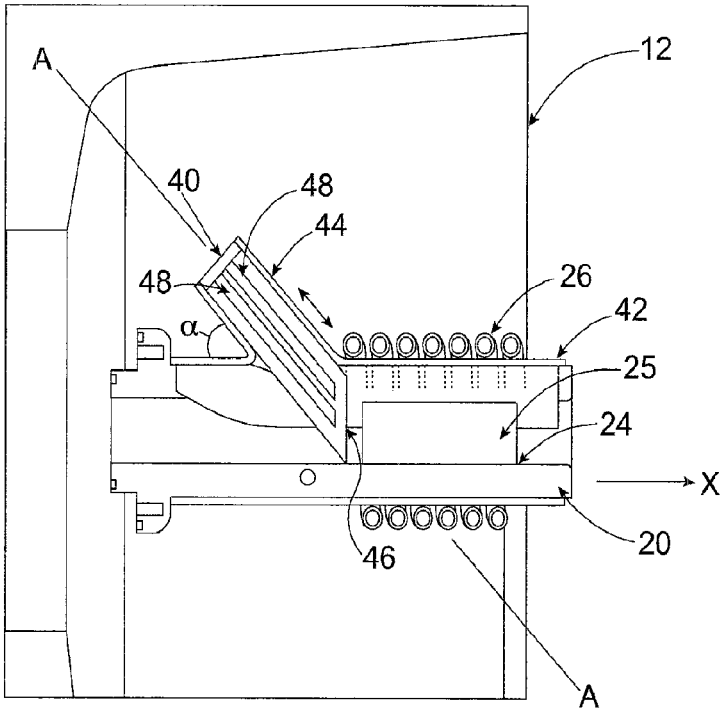
FIGS. 4 and 5 illustrate a detailed, sectional view of a gate associated with vessel in injection molding system in a first position and a second position, respectively, in accordance with an embodiment.
Figure 5:
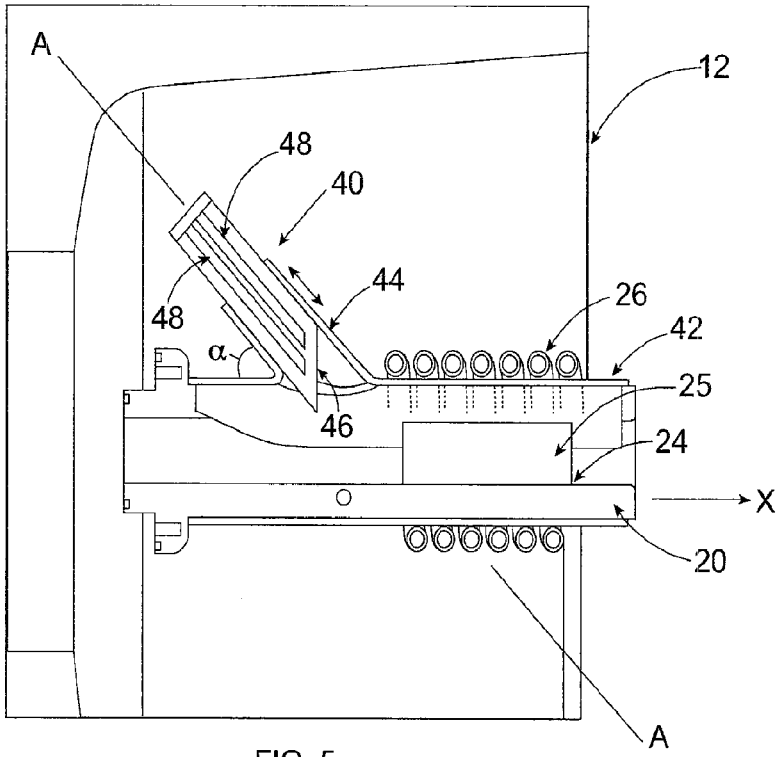

Turning now to the Figures, FIGS. 4 and 5 illustrate a detailed, sectional view of one embodiment of a gate 40 associated with vessel 20 in injection molding system 10 in a first position and a second position, respectively. In this embodiment, sleeve 42 includes a protrusion 44 extending therefrom from which a gate is configured to move within (extend and retract) to its first and second positions. Protrusion 44 is positioned such that it enables movement of at least part of gate 40 into the body of vessel 20 and in contact with its melting portion 24. Protrusion 44 is positioned on sleeve 42 such that it allows gate 40 to enter within top portion of the U-shaped vessel 20. More specifically, gate 40 is a linear actuating gate mounted at an angle with respect to vessel 20. Protrusion 44 of sleeve 42 is mounted diagonally on an axis A-A that is positioned at an angle $\alpha$ with respect to the axis of vessel 20 (on X axis). Thus, gate 40 is configured to move in a diagonal direction with respect to the vessel between the first position and the second position linearly along axis A-A. In an embodiment, the protrusion 44 may be provided at an angle $\alpha$ between about 15 and about 90 degrees, relative to sleeve 42, such that gate 40 is positioned at a similar angle relative to vessel 20. However, the angle of attachment of gate 40 is not meant to be limiting.

In an embodiment, the angle $\alpha$ at which protrusion 44 is provided relative to the vessel is about 90 degrees, i.e., the gate is configured to move in a perpendicular direction with respect to the vessel when moving between its first and second positions. An angle of about 90 degrees allows shortening of the length (in the horizontal/longitudinal direction) of the vessel, which in turn assists in reducing unwanted cooling of molten material and thus improves cast quality of the material.

Gate 40 includes a contact surface (or tip) 46 that is configured to limit movement of material as it is melted and/or in a molten state during the melting process. The tip may be provided at an angle relative to its body. For example, in the first position, the tip 46 of the gate may be configured to extend vertically relative to the melting portion 24 of vessel 20. The contact surface or tip 46 may be formed of similar or different material than a body of gate 40. Any number of materials may be used to form gate 40. Gate 40 is moved to its first position (FIG. 4) or second position (FIG. 5) by an actuation mechanism or device (not shown), which was described above. For example, prior to melting, gate 40 may be positioned (or moved, if needed) in the first (closed) position of FIG. 4. Gate 40 can be provided in its first position before or after insertion of material to be melted (ingot 25) into vessel 20. Gate 40 remains in position during the melting process to contain a material in a meltable form within vessel 20 during melting of the material, and, when the desired temperature/steady state/molten material is reached, gate 40 can be actuated to move to its second (open) position as shown in FIG. 5 to allow movement of the material in a molten form through the ejection path of vessel 20 and into mold 16. Accordingly, the configuration of gate 40 is designed to provide an uninterrupted movement between and to the first and second positions. Gate 40 is able to maintain the material being incited within induction coil field/melt zone 12 during the melting process (e.g., along with plunger 14 on an opposite side or end of the vessel).

In accordance with an embodiment, gate 40 may be configured to include a body and/or a tip 46 that can be temperature controlled or cooled (e.g., during the melting process). The gate can be cooled via conduction, convection, a gas, or a fluid, continuously or intermittently. In an embodiment, as shown in FIG. 4, one or more temperature regulating lines 48 can be provided in gate and configured to flow a liquid (e.g., water, or other fluid) therein for regulating a temperature of the gate (or its tip) during melting of material received in the vessel (e.g., to force cool the gate and/or its tip). The line(s) can assist in preventing excessive heating and melting of the gate or gate tip itself. The line(s) may be connected to a cooling system configured to induce flow of a liquid in the vessel. The line(s) may include one or more inlets and outlets for the liquid or fluid to flow therethrough. The inlets and outlets of the lines may be configured in any number of ways and are not meant to be limited. The number, positioning and/or direction of the line(s) should not be limited. The cooling liquid or fluid may be configured to flow through the line(s) during melting of the meltable material, when the gate is in a first (closed) position to enclose ingot for and during melting, and/or when induction source 26 is powered.

Figure 6:
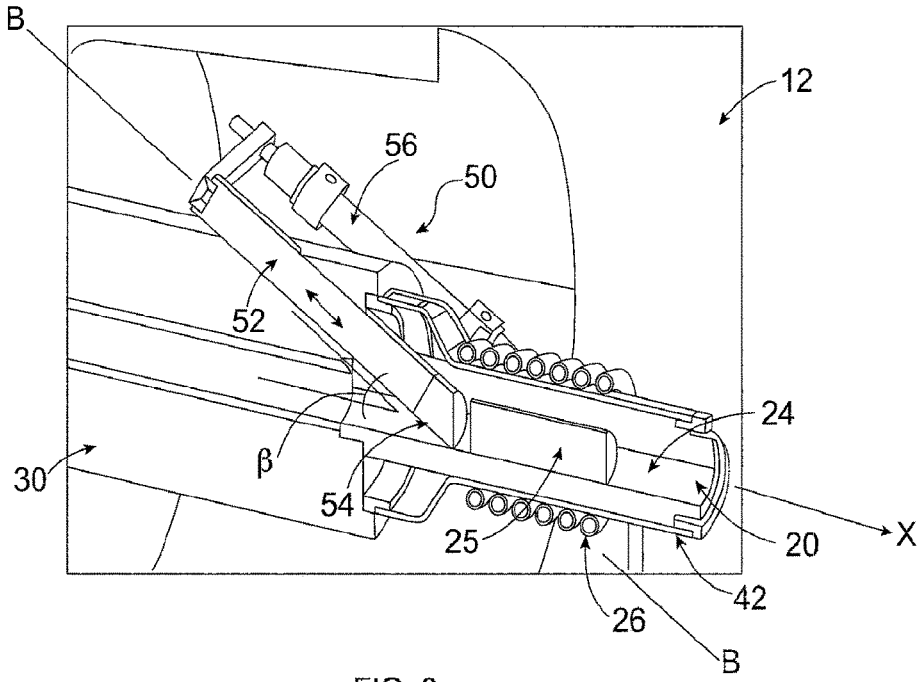
FIGS. 6 and 7 illustrate a detailed, perspective and sectional view of a gate associated with vessel in injection molding system in a first position and a second position, respectively, in accordance with another embodiment.
Figure 7:
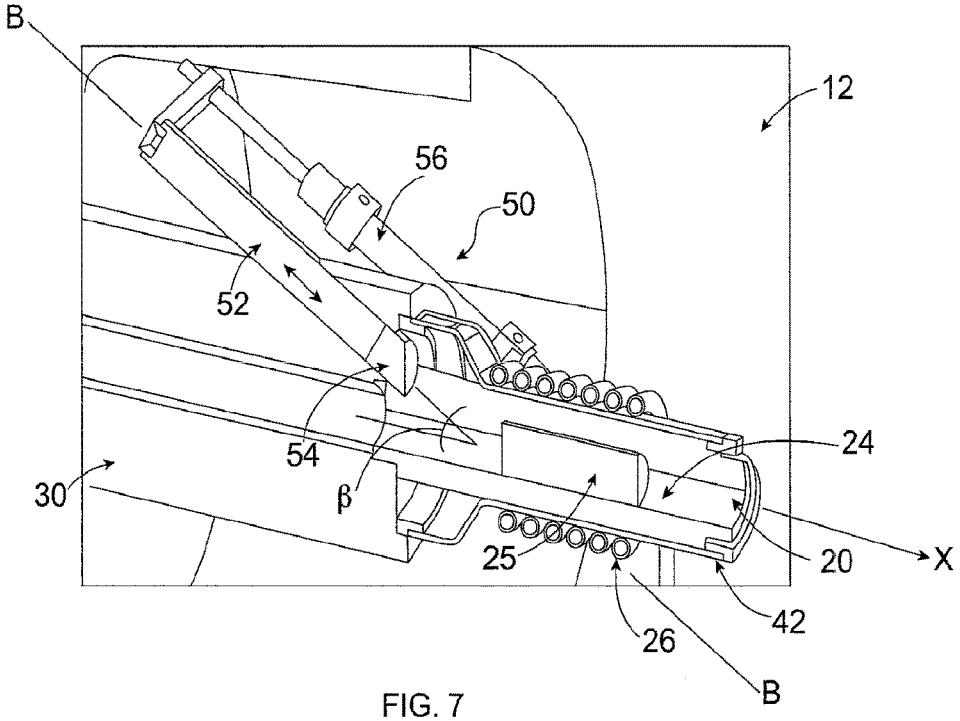

FIGS. 6 and 7 illustrate a detailed, perspective and sectional view of another embodiment a gate 50 associated with vessel 20 in injection molding system 10 in a first position and a second position, respectively. In this embodiment, entry and relative movement of gate 50 is accomplished outside of the sleeve 42. More specifically, gate 50 is configured to enter into vessel 20 via extending through transfer sleeve 30 and into the ejection path of vessel 20, such that at least its tip 54 is provided to contact and retain material during melting. The transfer sleeve 30 may include seals such that the melt zone 12 remains vacuumed sealed, when in use. Gate 50 is configured to move within (extend and retract) to its first and second positions. Gate 50 is a linear actuating gate mounted at an angle β with respect to vessel 20. More specifically, gate 50 is mounted diagonally on an axis B-B that is positioned at an angle with respect to the axis of vessel 20 (on X axis). Thus, gate 50 is configured to move in a diagonal direction with respect to the vessel between the first position and the second position linearly along axis B-B. In an embodiment, the gate 50 may be provided at an angle β between about 30 and about 90 degrees, relative to sleeve 42 and/or vessel 20. In an embodiment, the angle β is about 45 degrees. In an embodiment, the reach within the induction zone or melt zone 12 may be dependent on the installation angle of the gate 50. However, the angle of attachment of gate 50 is not meant to be limiting.

Gate 50 includes a body 52 and a contact surface (or tip) 54 that is configured to limit movement of material as it is melted and/or in a molten state during the melting process. The tip may be provided at an angle relative to its body. For example, in the first position, the tip 54 of the gate may be configured to extend vertically relative to the melting portion 24 of vessel 20. In FIGS. 6 and 7, the contact surface or tip 54 is formed of different material than body 52 of gate 54. For example, body 52 may be made of a copper material, while tip 54 is made of a ceramic material. Any number of materials may be used to form gate 50. Gate 50 is moved to its first position (FIG. 6) or second position (FIG. 6) by an actuation mechanism or device 56, such as those that were described above. For example, actuation mechanism 56 may include a pneumatic piston for moving gate 50 to and between its first and second positions. Prior to melting, gate 50 may be positioned (or moved, if needed) in the first (closed) position of FIG. 6. Gate 50 can be provided in its first position before or after insertion of material to be melted (ingot 25) into vessel 20. Gate 50 remains in position during the melting process to contain a material in a meltable form within vessel 20 during melting of the material, and, when the desired temperature/steady state/molten material is reached, gate 50 can be actuated to move to its second (open) position as shown in FIG. 7 to allow movement of the material in a molten form through the ejection path of vessel 20, through transfer sleeve 30, and into mold 16. Accordingly, the configuration of gate 50 is designed to provide an uninterrupted movement between and to the first and second positions. Gate 50 is able to maintain the material being melted within induction coil field/melt zone 12 during the melting process (e.g., along with plunger 14 on an opposite side or end of the vessel). It does not require reconfiguration or alteration to sleeve 42. Gate 50 maintains a simpler design of sleeve 42 (without need for forming a protrusion, such as protrusion 44 shown in FIG. 4), and provides an easy to integrate actuation mechanism provided adjacent the melt zone 12.

Figure 8:
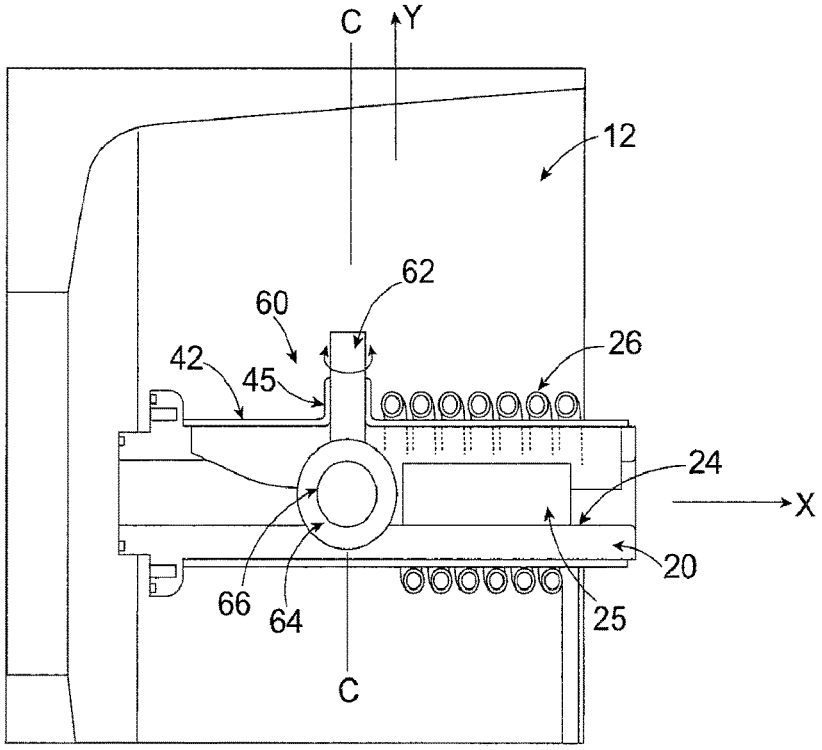
FIGS. 8 and 9 illustrate a detailed, sectional view of a rotatable gate associated with vessel in injection molding system in a first position and a second position, respectively, in accordance with an embodiment.
Figure 9:
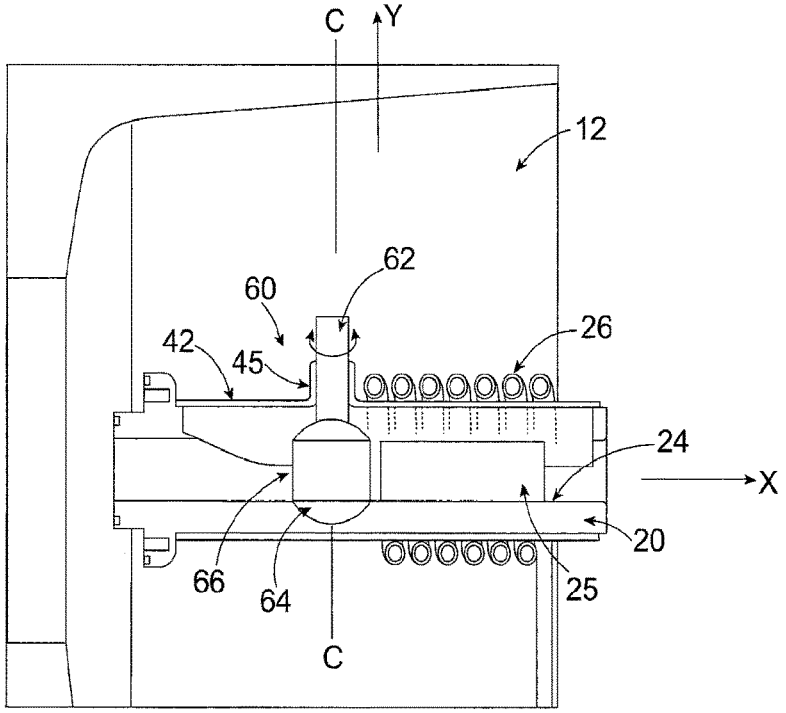

FIGS. 8 and 9 illustrate a detailed, sectional view of a rotatable gate 60 associated with vessel 20 in injection molding system 10 in a first position and a second position, respectively, in accordance with an embodiment. In this embodiment, sleeve 42 includes a protrusion 45 extending therefrom from which at least a part of gate is configured to rotationally move therein to its first and second positions. Protrusion 45 is positioned on sleeve 42 such that it allows gate 60 to be positioned through and into body within top portion of the U-shaped vessel 20. More specifically, gate 60 is a rotationally actuated gate. Protrusion 45 of sleeve 42 is mounted vertically on an axis C-C (on Y-axis) that is positioned perpendicularly with respect to the axis of vessel 20 (on X axis), e.g., at an angle of 90 degrees relative to X-axis. Thus, gate 60 is positioned for movement about a vertical axis (axis C-C) relative to the axis of vessel 20 (X-axis). Gate 60 comprises an extension 62 that extends vertically through protrusion 45 for actuation and movement (i.e., rotation) of its body 64 to first or second positions. Body 64 is formed such that its walls prevent material being melted from moving or leaving through ejection path by containing molten material within a melt zone of the apparatus. Body 64 also comprises an opening 66 therethrough. For example, in an embodiment, gate 60 may be in the form of a ball valve. Opening 66 allows for movement of material in a molten state from melting portion 24 of vessel, through its ejection path and towards/into mold 16. In an embodiment, this gate can be temperature controlled via a fluid.

Body 64 of gate 60 is configured to limit movement of material as it is melted and/or in a molten state during the melting process. Body 64 may be formed of similar or different material than extension 62. Any number of materials may be used to form gate 60. Gate 60 is moved to its first position (FIG. 8) or second position (FIG. 8) by an actuation mechanism or device (not shown), which was described above. The actuation device is configured to rotationally move extension rotationally about axis C-C. For example, prior to melting, gate 60 may be positioned (or moved, if needed) in the first (closed) position of FIG. 8, such that body 64 blocks movement of material. Gate 60 can be provided in its first position before or after insertion of material to be melted (ingot 25) into vessel 20. Gate 60 remains in position during the melting process to contain a material in a meltable form within vessel 20 during melting of the material, and, when the desired temperature/steady state/molten material is reached, gate 60 can be actuated to rotate about axis C-C to its second (open) position as shown in FIG. 9 to allow movement of the material in a molten form through opening 66, through ejection path of vessel 20, and into mold 16. Gate 60 is configured to rotate 90 degrees from the first position to the second position. Accordingly, the configuration of gate 60 is designed to provide an uninterrupted movement between and to the first and second positions. It provides use of 90 degree rotary motion between its first and second positions. Any seals used therewith are less likely to be contaminated. Gate 60 is able to maintain the material being melted within induction coil field/melt zone 12 during the melting process (e.g., along with plunger. 14 on an opposite side or end of the vessel). In an embodiment, the tip of the plunger is sized such that it can extend through opening 66 in order to move molten material into mold 16. In an embodiment, this gate can be temperature controlled via a fluid.

Figure 10:
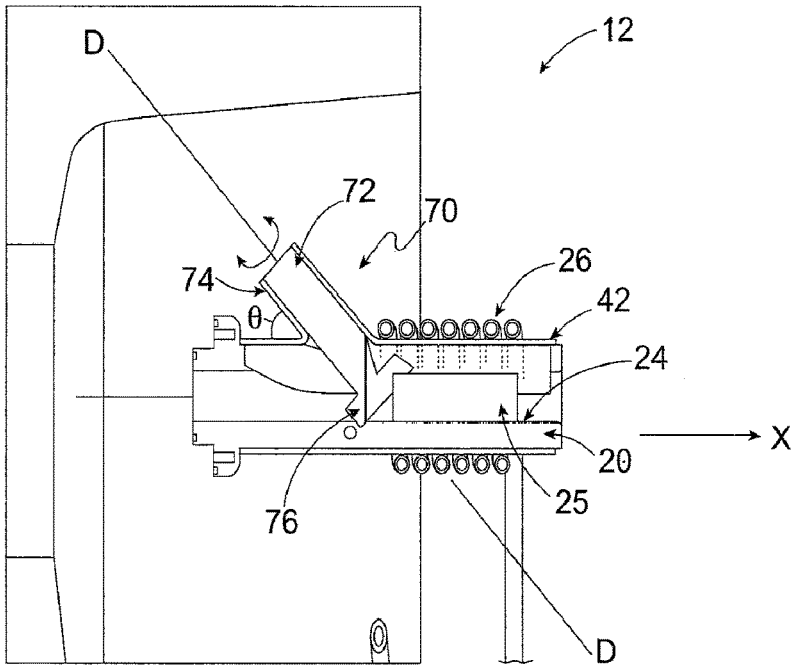
FIGS. 10 and 11 illustrate a detailed, sectional view of an alternate gate associated with vessel in injection molding system in a first position and a second position, respectively, in accordance with another embodiment.
Figure 11:
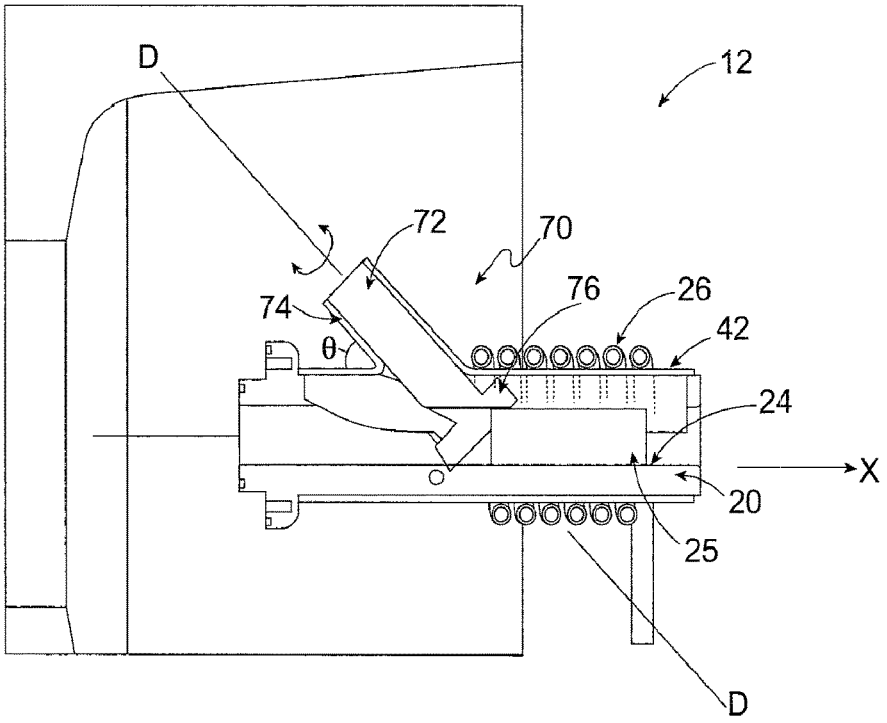

FIGS. 10 and 11 illustrate a detailed, sectional view of another alternate gate 70 associated with vessel 20 in injection molding system 10 in a first position and a second position, respectively. In this embodiment, sleeve 42 includes a protrusion 74 similar to protrusion 44 shown in FIGS. 4 and 5, that extends from the sleeve and enables at least a part of gate to rotationally move therein to its first and second positions. Protrusion 74 is positioned such that it enables movement of at least part of gate 70 (e.g., tip 76) in the body of vessel 20 and in contact with its melting portion 24. Protrusion 74 is positioned on sleeve 42 such that it allows gate 70 to be positioned through and into body within top portion of the U-shaped vessel 20. More specifically, gate 70 is a rotationally actuated gate mounted at an angle with respect to vessel 20. Protrusion 74 of sleeve 42 is mounted diagonally on an axis D-D that is positioned at an angle with respect to the axis of vessel 20 (on X axis). Gate 70, is positioned in a diagonal direction with respect to the vessel between the first position and the second position linearly along axis A-A, but is configured to rotate with respect to vessel 20 between its first position and the second position. In an embodiment, the protrusion 74 may be provided at an angle Θ between about 30 and 90 degrees, relative to sleeve 42, such that gate 70 is positioned at a similar angle relative to vessel 20. In another embodiment, protrusion 74 is positioned at an angle Θ of about 45 degrees relative to the axis of vessel 20 (X axis). However, the angle of attachment of gate 70 is not meant to be limiting. In an embodiment, this gate can be temperature controlled via a fluid.

Gate 70 includes a contact surface (or tip) 76 that is configured to limit movement of material as it is melted and/or in a molten state during the melting process. The tip may be provided at an angle relative to its body. For example, in the first position, the tip 76 of the gate may be configured to extend vertically relative to the melting portion 24 of vessel 20. However, after rotation of the gate 70, tip 76 may be configured to extend horizontally and parallel to the melting portion 24 of vessel. The contact surface or tip 76 may be formed of similar or different material than a body 72 of gate 70. Any number of materials may be used to form gate 70. Gate 70 is moved to its first position (FIG. 10) or second position (FIG. 11) by an actuation mechanism or device (not shown), which was described above. For example, prior to melting, gate 70 may be positioned (or moved, if needed) in the first (closed) position of FIG. 10. Gate 70 can be provided in its first position before or after insertion of material to be melted (ingot 25) into vessel 20. Gate 70 remains in position during the melting process to contain a material in a meltable form within vessel 20 during melting of the material, and, when the desired temperature/steady state/molten material is reached, gate 70 can be actuated and rotated to move to its second (open) position as shown in FIG. 11 to allow movement of the material in a molten form through the ejection path of vessel 20 and into mold 16. Gate 70 is configured to rotate 180 degrees from the first position to the second position. Accordingly, the configuration of gate 70 is designed to provide an uninterrupted movement between and to the first and second positions. It provides use of 180 degree rotary motion between its first and second positions. Any seals used therewith are less likely to be contaminated. Gate 70 is able to maintain the material being melted within induction coil field/melt zone 12 during the melting process (e.g., along with plunger 14 on an opposite side or end of the vessel). In an embodiment, the tip of the plunger is sized such that it can extend under the tip 76 when the gate 70 is in the second position in order to move molten material into mold 16. In an embodiment, this gate can be temperature controlled via a fluid.

Figure 12:
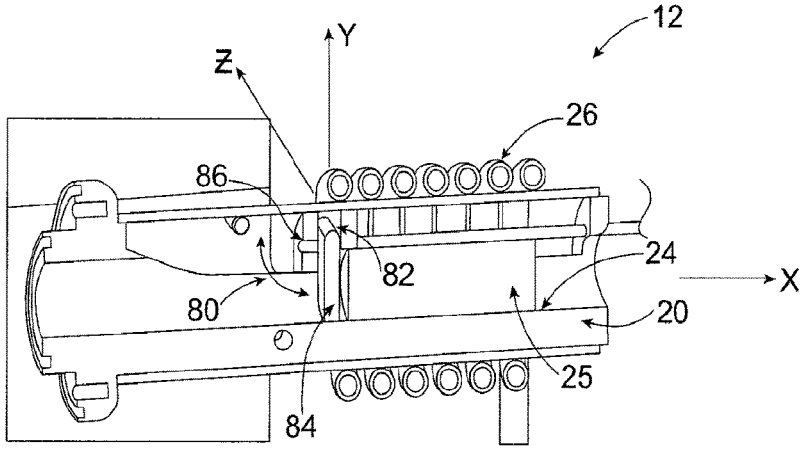
FIGS. 12 and 13 illustrate a detailed, sectional view of a hinged gate associated with vessel in injection molding system in a first position and a second position, respectively, in accordance with an embodiment.
Figure 13:
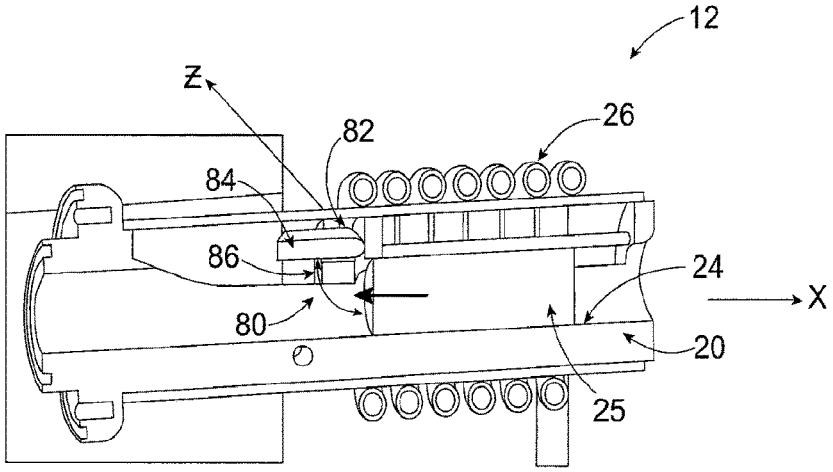

FIGS. 12 and 13 illustrate an alternate embodiments showing a detailed, sectional view of a hinged gate 80 associated with vessel 20 in injection molding system 10 in a first position and a second position, respectively. In this embodiment, sleeve 42 surrounds at least melting portion 24 of vessel 20. Gate 80 has a body 82 and a hinge 84 for rotation between its first and second positions. Gate 80 is configured to rotate with respect to vessel 20. More specifically, gate 80 is configured to be a gravity actuated gate, such as a flapper, that is pivoted within the induction zone and held in its first (closed) position based on its own weight. Gate 80 may be moved or opened to its second position either by the force of the melt being pushed against it (as it is advanced through the ejection part of the vessel after the melting process), or by the force a push-rod, for example. Alternative methods and/or parts, such as a rod, a magnet, and/or an actuator, may also or alternatively be used to move gate 80. In an embodiment, this gate can be temperature controlled via a fluid.

Figure 14:
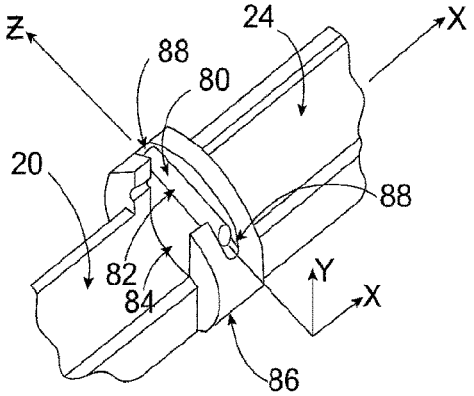
FIG. 14 illustrates an overhead perspective view of the hinged gate of FIG. 12 in the first position.

As shown better in the overhead view of FIG. 14, gate 80 may be mounted to a portion 86 surrounding vessel 20. Portion 86 may be positioned in a position on vessel 20 that is adjacent to a location of the induction coil 26, for example, such that gate 80 may be positioned to contain material within an induction zone of the melt zone 12 during melting. Portion 86 may be formed or manufactured separately and attached to a vessel, or integrally with body of a vessel. Portion 86 can be configured to be surrounded by sleeve 42.

Portion 86 includes at least one mounting area 88 for a hinge of gate 80. In the illustrated embodiment, portion 86 is a circular shaped piece with a mounting area 88 on either side of the U-shaped vessel that are each configured to receive an end of hinge 84. Portion 86 is positioned on vessel 20 such that it allows gate 80 to be positioned through and into body within top portion of the U-shaped vessel 20. Mounting areas 88 of portion 86 are aligned to position hinge 84 horizontally on an axis (on Z-axis) that is positioned perpendicularly with respect to the axis of vessel 20 (on X axis), e.g., at an angle of 90 degrees relative to X-axis and perpendicularly to Y axis. Thus, gate 80 is positioned for rotational or hinged movement about Z axis relative to the axis of vessel 20 (X-axis).

Body 82 of gate 80 is configured to limit movement of material as it is melted and/or in a molten state during the melting process. Any number of materials may be used to form gate 80. Again, gate 80 is gravity actuated by its own body weight (e.g., weight of body 82) to be provided in its first (closed) position. Thus, gate 80 is provided (e.g., by default) in first position (FIG. 12), prior to melting, and/or before insertion of material to be melted (ingot 25) into vessel 20. Gate 80 remains in position during the melting process to contain a material in a meltable form within vessel 20 during melting of the material, and, when the desired temperature/steady state/molten material is reached, gate 80 can be actuated to rotate about the Z axis to its second (open) position as shown in FIG. 13 to allow movement of the material in a molten form through opening 66, through ejection path of vessel 20, and into mold 16 by moving plunger 14 through vessel 20. Force from the molten material and/or tip of plunger 14 will cause the gate 80 to rotate about its hinge 84 and flip upwardly towards the sleeve 42. Gate 80 is configured to rotate 90 degrees from the first position to the second position. Accordingly, the configuration of gate 80 is designed to provide an uninterrupted movement between and to the first and second positions. It provides use of 90 degree rotary motion between its first and second positions. It does not require reconfiguration or alteration to sleeve 42. Gate 80 is able to maintain the material being melted within induction coil field/melt zone 12 during the melting process (e.g., along with plunger 14 on an opposite side or end of the vessel). Gate 80 maintains a simpler design of sleeve 42 (without need for forming a protrusion, such as protrusion 44 shown in FIG. 4), and provides an easy to integrate actuation mechanism provided adjacent the melt zone 12.

Figure 15:
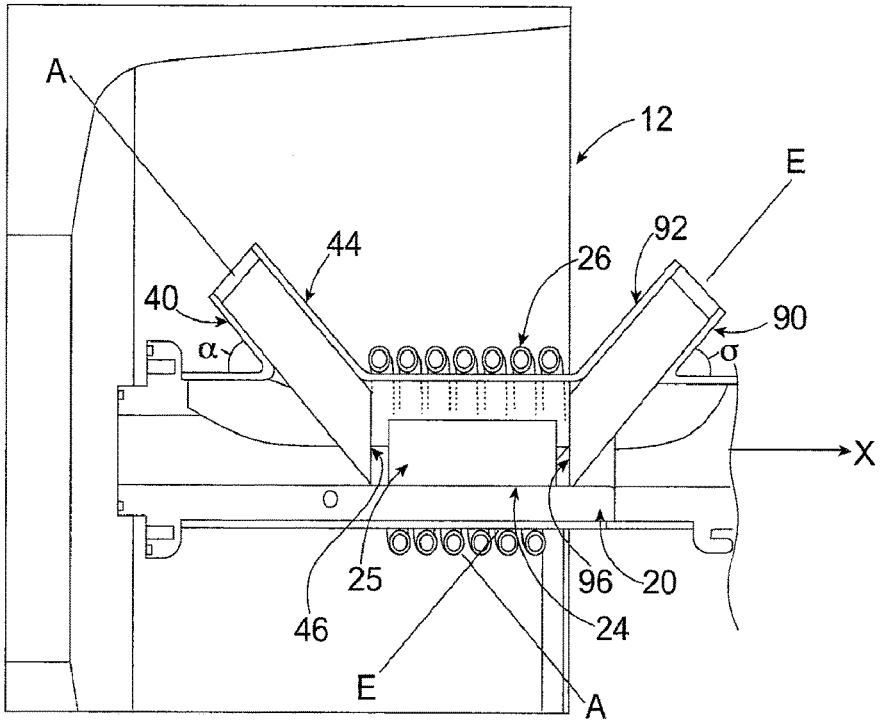
FIGS. 15 and 16 illustrate a detailed, sectional view of a dual gate system associated with vessel in injection molding system in a first position and a second position, respectively, in accordance with an embodiment.
Figure 16:
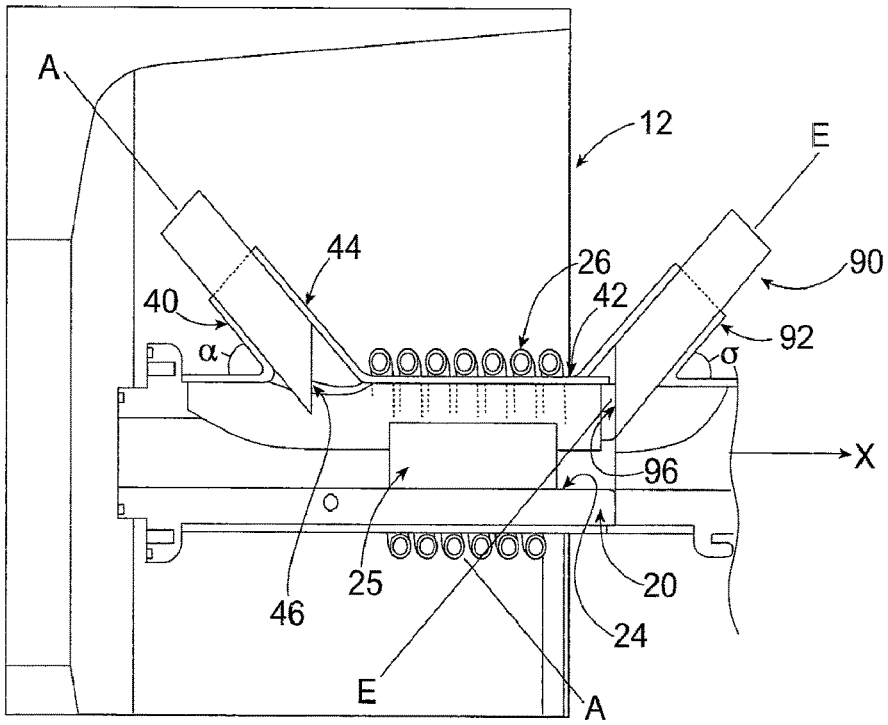

In accordance with yet another yet embodiment, a dual gate system (instead of single gate on one end side or ejection path of the vessel 20 with plunger 14 acting as a gate on the other, opposite end side during the melting process) can be employed in an injection molding system such as apparatus 10. FIGS. 15 and 16 illustrate an example of gate mechanism on both a down-stream side and an up-stream side of the induction coil. Shown is a detailed, sectional view of a dual gate system associated with vessel 20 in injection molding system 10 in a first position and a second position, respectively, in accordance with an embodiment. FIGS. 15 and 16 are similar to the design shown and described in FIGS. 4 and 5, includes gate 40 positioned in protrusion 44 of sleeve 42 and configured to move between its first and second positions, as explained above. Description of gate 40 is hereby incorporated in this embodiment, and thus is not re-stated for simplicity purposes only. Furthermore, FIGS. 15 and 16 show an additional gate 90 configured to restrict an opposite side of vessel 20. The opposite side is an end side which can be used, in some embodiments, as an injection side for injecting material (e.g., ingot 25) from a loading port 18, for example. Additional gate 90 is configured contain the material in a meltable form within the vessel during melting of the material instead of using plunger 14 (or plunger tip) during the melting process. In this embodiment, sleeve 42 further includes a second protrusion 92 extending therefrom from which additional gate 90 is configured to move within (extend and retract) to its first and second positions. Protrusion 92 is positioned such that it enables movement of at least part of additional gate 90 into the body of vessel 20 and in contact with its melting portion 24 on other end of vessel 20. Protrusion 92 is positioned on sleeve 42 such that it allows additional gate 90 to enter within top portion of the U-shaped vessel 20. More specifically, additional gate 90 is a linear actuating gate mounted at an angle with respect to vessel 20. Protrusion 92 of sleeve 42 is mounted diagonally on an axis E-E that is positioned at an angle σ with respect to the axis of vessel 20 (on X axis). Thus, additional gate 90 is configured to move in a diagonal direction with respect to the vessel between the first position and the second position linearly along axis E-E, in similar manner as shown by gate 40. In an embodiment, the protrusion 92 may be provided at an angle σ between about 15 and about 90 degrees, relative to sleeve 42, such that additional gate 90 is positioned at a similar angle relative to vessel 20. However, the angle of attachment of additional gate 90 is not meant to be limiting.

Like gate 40, additional gate 90 includes a contact surface (or tip) 96 that is configured to limit movement of material as it is melted and/or in a molten state during the melting process. The tip may be provided at an angle relative to its body. For example, in the first position, the tip 96 of additional gate 90 may be configured to extend vertically relative to the melting portion 24 of vessel 20. The contact surface or tip 96 of additional gate 90 may be formed of similar or different material than its body. Any number of materials may be used to form additional gate 90. Additional gate 90 is moved to its first position (FIG. 15) or second position (FIG. 16) by an actuation mechanism or device (not shown), which was described above. Gates 40 and 90 may be configured to move substantially together between their first and second positions. For example, prior to melting, additional gate 40 may be positioned (or moved, if needed) in the first (closed) position of FIG. 4. Gate 40 can be provided in its first position before or after insertion of material to be melted (ingot 25) into vessel 20. Gate 90, on the other hand, can be moved to its first (closed) position shown in FIG. 15 after insertion of ingot 25, if a loading port 18 and/or plunger 14 is used to load ingot 25 into melting portion 24 of vessel 20. Alternatively, both gates 40 and 90 can be linearly moved to their respective first (closed) positions after loading of material. Both gate 40 and additional gate 90 remain in their first positions during the melting process to contain a material in a meltable form within vessel 20, and, when the desired temperature/steady state/molten material is reached, gate 40 and additional gate 90 can be actuated to move to their respective second (open)

positions, as shown in FIG. 16, to allow movement of the material in a molten form through the ejection path of vessel 20 and into mold 16. In another embodiment, additional gate 90 can be first moved to its second position, such that plunger 14 can be moved into vessel 20 and configured to move molten material once gate 40 is moved to its second position. Nonetheless, once both gates are in the second position, plunger 14 is configured to push molten material through ejection path of vessel 20 and into mold. Accordingly, the configuration of gate 40 and additional gate 90 are designed to provide an uninterrupted movement between and to the first and second positions. Both gates 40 and 90 are able to maintain the material being melted within induction coil field/melt zone 12 during the melting process.

It should be noted that although FIGS. 15 and 16 illustrate the use of two gates that are similar to the configuration of gate 40 shown in FIGS. 4 and 5, any of the herein disclosed embodiments (e.g., linear moving or rotationally moving gates) could be mirrored and employed for use as an up-stream gate, either alone or in addition to the down-stream gates, as shown. A combination of different gate designs can also be used together.

Accordingly, the gates as described herein are meant to be illustrative only. The configuration for mounting and/or moving the gate should not be limiting.

Figure 17:
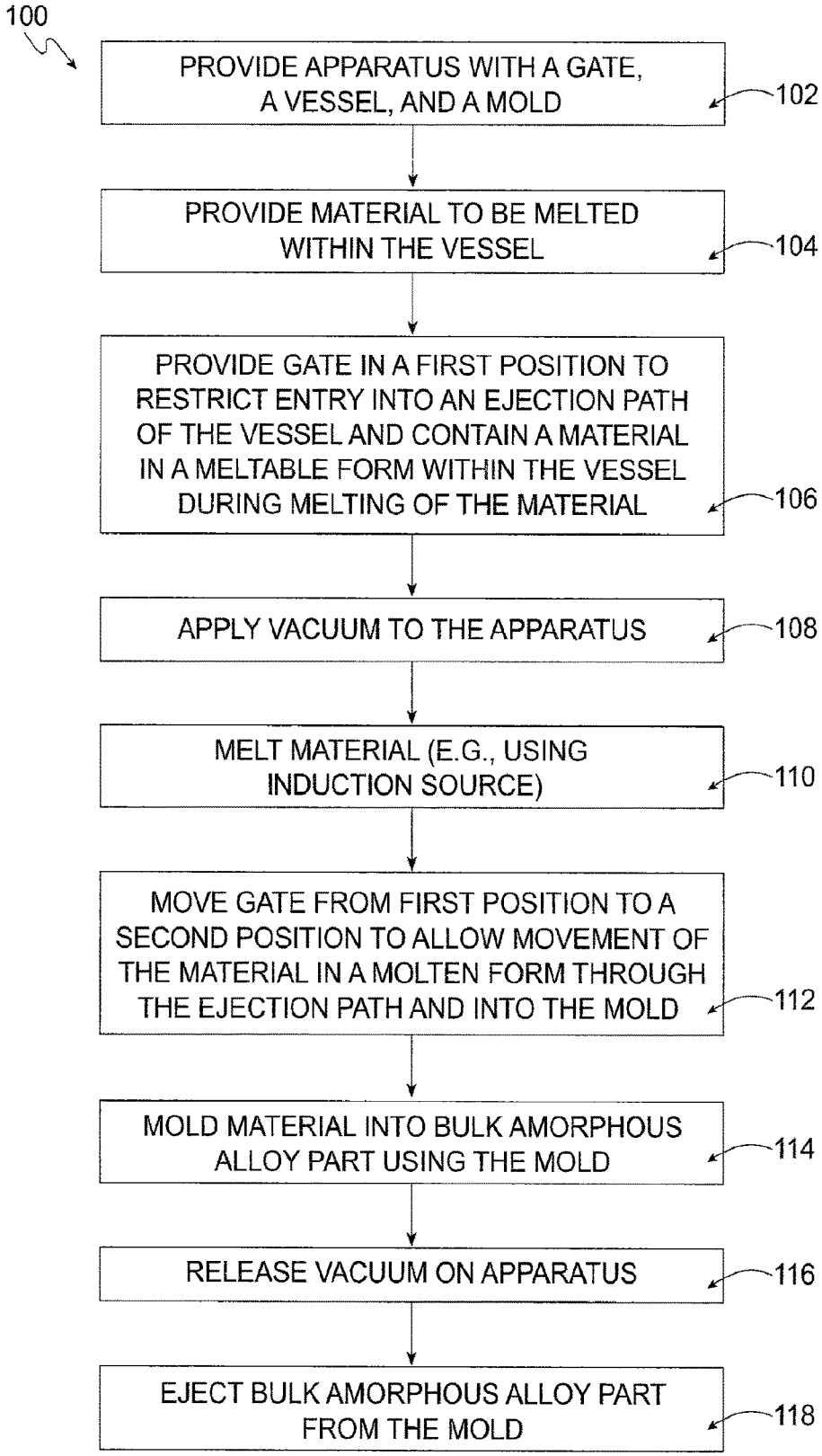
FIG. 17 illustrates a method for melting material and molding a part in accordance with an embodiment of the disclosure.

FIG. 17 illustrates a method for melting material and molding a part in accordance with an embodiment of the disclosure using apparatus 10, as shown in FIG. 3. The apparatus is designed to include a gate, vessel 20, and mold 16, as shown at 102. The gate may be any of the configurations described herein, or other configurations, that enable movement between a first position and a second position, to respectively stop and allow flow of material with vessel 20, as previously described. Generally, the injection molding system/apparatus 10 may be operated in the following manner: Meltable material (e.g., amorphous alloy or BMG in the form of a single ingot 25) is loaded into a feed mechanism (e.g., loading port 18), inserted and received into the melt zone 12 into the vessel 20 (surrounded by the induction coil 26), as shown at 104. At 106, the gate is provided in the first position to restrict entry into an ejection path of the vessel and contain a material in a meltable form within the vessel during melting of the material. The gate and/or vacuum may be applied to the apparatus 10 before or after loading material to be melted, as shown at 108. The injection molding machine "nozzle" stroke or plunger 14 can be used to move the material, as needed, into the melting portion 24 of the vessel 20. The material is heated through the induction process at 110 (i.e., by supplying power via a power source to induction coil 26). The injection molding machine controls the temperature through a closed or opened loop system, which will stabilize the material at a specific temperature (e.g., using a temperature sensor and a controller). During melting of the material, the gate is configured to allow the apparatus to be maintained under vacuum during the melting of the material. Also during heating/melting, a cooling system can be activated to flow a (cooling) liquid in any cooling line(s) of the vessel 20 and/or gate (or gate tip). Once the desired temperature is achieved and maintained to melt the meltable material, the heating using induction coil 26 can be stopped. As shown at 112, the gate is moved from the first position to the second position to allow movement of the material in a molten form through the ejection path and into the mold, and the machine will then begin the injection of the molten material from vessel 20, through transfer sleeve 30, and into vacuum mold 16 by moving in a horizontal direction (from right to left) along the horizontal axis (X axis). This may be controlled using plunger 14, which can be activated using a servo-driven drive or a hydraulic drive. The mold 16 is configured to receive molten material through an inlet and configured to mold the molten material under vacuum, as shown at 114. That is, the molten material is injected into a cavity between the at least first and second plates to mold the part in the mold 16. As previously noted, in some embodiments, the material may be an amorphous alloy material that is used to mold a bulk amorphous alloy part. Once the mold cavity has begun to fill, vacuum pressure (via the vacuum lines and vacuum source 38) can be held at a given pressure to "pack" the molten material into the remaining void regions within the mold cavity and mold the material. After the molding process (e.g., approximately 10 to 15 seconds), the vacuum pressure applied to at least the mold 16 (if not the entire apparatus 10) is released, as shown at 116. Mold 16 is then opened to relieve pressure and to expose the part to the atmosphere. At 118, an ejector mechanism is actuated to eject the solidified, molded object from between the at least first and second plates of mold 16 via an actuation device. Thereafter, the process can begin again. Mold 16 can then be closed by moving at least the at least first and second plates relative to and towards each other such that the first and second plates are adjacent each other. The melt zone 12 and mold 16 is evacuated via the vacuum source once the plunger 14 has moved back into a load position, in order to insert and melt more material and mold another part. The gate can be moved back to its first position before melting of the next ingot of material begins.

Accordingly, the herein disclosed embodiments illustrate use of at least one gate in an exemplary injection system that has its melting system in-line along a horizontal axis. The at least one gate may be provided on a down-steam/ejection side of the vessel so as to maintain the material during melting and in its molten state, and to induce steady state melting during melting process. It keeps the material adjacent to the induction zone formed by the induction coil during melting, which in turn can result in a more uniform molded part. Any of the gates disclosed herein can be used in combination with a different gate design. Any of the gates may be temperature controlled using a fluid. Additionally, in a design wherein two gates are utilized to contain material to be melted in the induction/melt zone, either or both of the gates may be temperature controlled using a fluid.

Although not described in great detail, the disclosed injection system may include additional parts including, but not limited to, one or more sensors, flow meters, etc. (e.g., to monitor temperature, cooling water flow, etc.), and/or one or more controllers. Also, seals can be provided with or adjacent any of number of the parts to assist during melting and formation of a part of the molten material when under vacuum pressure, by substantially limiting or eliminating substantial exposure or leakage of air. For example, the seals may be in the form of an O-ring. A seal is defined as a device that can be made of any material and that stops movement of material (such as air) between parts which it seals. The injection system may implement an automatic or semi-automatic process for inserting meltable material therein, applying a vacuum, heating, injecting, and molding the material to form a part.

The material to be molded (and/or melted) using any of the embodiments of the injection system as disclosed herein may include any number of materials and should not be limited. In one embodiment, the material to be molded is an amorphous alloy, as described in detail above.

The types and materials used for gates in any of the illustrative embodiments herein is not meant to be limited. Furthermore, it should be noted that, although only illustrated in FIG. 4, any of the herein described embodiments of gates (or their tips) as shown in FIGS. 6-16 may be configured to be temperature controlled or cooled in some way.

In accordance with an embodiment, the gate is a temperature controlled gate made of copper. In another embodiment, the gate is a temperature controlled gate made of copper that is coated with a coating of another material, such as ceramic. In another embodiment, the gate is a temperature controlled gate lined with a material, such as ceramic.

In another embodiment, the gate is a temperature controlled gate made of ceramic. In another embodiment, the gate is a temperature controlled gate made of ceramic that is coated with a coating of another material. In another embodiment, the gate is a temperature controlled gate lined with a material.

However, the gate need not be temperature controlled. In yet another embodiment, the gate is a gate made of ceramic. In another embodiment, the gate is made of ceramic that is coated with a coating of another material. In another embodiment, the gate is lined with a material.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that many of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. An apparatus comprising:
- a vessel comprising:
  - a melt zone configured to receive a material; and
  - an ejection path adjacent the melt zone and extending along a horizontal direction; and
- a gate comprising one or more temperature regulating lines configured to flow a liquid therein to regulate a temperature of the gate during melting of the material, the gate positioned between the ejection path and the melt zone and configured to move between:
  - a first position to contain the material within the melt zone during melting of the material; and
  - a second position to allow movement of the material in a molten form past the gate and through the ejection path in the horizontal direction.

2. The apparatus according to claim 1, wherein:
- the gate is positioned at a first end of the melt zone; and
- the apparatus further comprises:
  - a plunger positioned at a second end of the melt zone opposite the first end and configured to:
    - contain the material within the melt zone during melting of the material; and
    - move the material in the molten form through the ejection path.

3. The apparatus according to claim 1, further comprising an actuation mechanism associated with the gate to selectively move the gate between the first position and the second position.

4. The apparatus according to claim 1, wherein the gate is configured to move along a direction that is oblique to the horizontal direction when moving between the first position and the second position.

5. The apparatus according to claim 1, wherein the gate is configured to rotate with respect to the vessel when moving between the first position and the second position.

6. The apparatus according to claim 5, wherein the gate is configured to rotate 90 degrees from the first position to the second position.

7. The apparatus according to claim 5, wherein the gate is configured to rotate 180 degrees from the first position to the second position.

8. The apparatus according to claim 7, wherein the gate rotates about an axis that is oblique to the horizontal direction.

9. The apparatus according to claim 5, wherein the gate comprises a hinge configured to allow rotation of the gate with respect to the vessel.

10. The apparatus according to claim 1, wherein:
- the gate is a first gate;
- the first gate is positioned at a first end of the melt zone; and
- the apparatus further comprises an additional gate positioned at a second end of the melt zone opposite the first end and configured to contain the material within the melt zone during melting of the material.

11. The apparatus according to claim 1, further comprising an induction coil surrounding at least part of the melt zone and configured to melt the material.

12. The apparatus according to claim 1, further comprising a mold configured to receive the material in the molten form from the ejection path of the vessel and to mold the material in the molten form into a molded part.

13. The apparatus according to claim 12, wherein the molded part is a bulk amorphous alloy part.

14. An apparatus comprising:
- a vessel comprising:
  - a melt zone configured to receive a material; and
  - an ejection path adjacent the melt zone and extending along a horizontal direction;
- a first gate positioned at a first end of the melt zone between the ejection path and the melt zone and configured to move between:
  - a first position to contain the material within the melt zone during melting of the material; and
  - a second position to allow movement of the material in a molten form past the first gate and through the ejection path in the horizontal direction; and
- a second gate positioned at a second end of the melt zone opposite the first end and configured to contain the material within the melt zone during melting of the material.

15. The apparatus of claim 14, further comprising a plunger positioned at a second end of the melt zone opposite the first end and configured to move the material in the molten form through the ejection path.

16. The apparatus of claim 14, further comprising an actuation mechanism coupled to the first gate to selectively move the first gate between the first position and the second position.

17. The apparatus of claim 14, wherein the second gate is configured to move between:
- a third position to contain the material within the melt zone during melting of the material; and
- a fourth position to allow movement of a plunger through the melt zone.

18. The apparatus of claim 14, wherein the first gate is configured to move along a direction that is oblique to the horizontal direction when moving between the first position and the second position.

19. The apparatus of claim 14, wherein the first and second gates each comprise one or more temperature regulating lines configured to flow a liquid therein to regulate a temperature of the first and second gates during melting of the material.

20. The apparatus of claim 14, wherein the first gate is a ball valve.

21. The apparatus of claim 14, wherein the first and the second gates are configured to move substantially simultaneously.

22. An apparatus comprising:

a vessel comprising:

a melt zone configured to receive a material; and an ejection path adjacent the melt zone and extending along a horizontal direction; and a gate positioned between the ejection path and the melt zone and configured to move along a direction that is oblique to the horizontal direction to move between:

a first position to contain the material within the melt zone during melting of the material; and a second position to allow movement of the material in a molten form past the gate and through the ejection path in the horizontal direction.

23. The apparatus of claim 22, wherein, when moving between the first position and the second position, the gate moves linearly along the direction that is oblique to the horizontal direction.

24. The apparatus of claim 23, wherein:

the gate is positioned at a first end of the melt zone; and the apparatus further comprises a plunger positioned at a second end of the melt zone opposite the first end and configured to move the material in the molten form past the gate and through the ejection path.

25. The apparatus of claim 24, wherein the plunger is further configured to contain the material within the melt zone during melting of the material.

26. The apparatus of claim 23, further comprising a piston coupled to the gate and configured to move the gate between the first position and the second position.

27. The apparatus of claim 22, wherein:

the gate is a first gate;

the first gate is positioned at a first end of the melt zone; and the apparatus further comprises a second gate positioned at a second end of the melt zone opposite the first end.

28. The apparatus of claim 22, further comprising an induction coil encircling at least part of the melt zone and configured to melt the material.

* * * * *